US006220589B1

(12) United States Patent
Smith, III et al.

(10) Patent No.: US 6,220,589 B1
(45) Date of Patent: Apr. 24, 2001

(54) DUAL ACTION CLAMP

(75) Inventors: Eugene L. Smith, III, Chicago, IL (US); James J. Gurule, Danville, CA (US)

(73) Assignee: Adjustable Clamp Company, Chicago, IL (US)

( * ) Notice: Subject to any disclaimer, the term of this patent is extended or adjusted under 35 U.S.C. 154(b) by 0 days.

(21) Appl. No.: 09/477,998

(22) Filed: Jan. 5, 2000

(51) Int. Cl.[7] ..... B25B 1/00
(52) U.S. Cl. ..... 269/156; 269/43; 269/133
(58) Field of Search ..... 267/43, 156, 104, 267/133, 87.3, 235, 246, 231, 244

(56) References Cited

U.S. PATENT DOCUMENTS

| | | | | |
|---|---|---|---|---|
| 1,194,666 | * | 8/1916 | Romanowski | 269/156 |
| 1,402,621 | * | 1/1922 | Knittel | 269/156 |
| 1,788,546 | * | 1/1931 | Schmieder | 269/156 |
| 2,430,613 | * | 11/1947 | Hodge | 269/231 |
| 2,605,795 | * | 8/1952 | Tracy | 269/133 |
| 2,642,905 | * | 6/1953 | Hewat | 144/304 |
| 4,957,257 | * | 9/1990 | Gonzalez | 248/231.7 |
| 5,277,412 | * | 1/1994 | Pringle | 269/47 |
| 5,697,601 | * | 12/1997 | Gurule | 269/43 |
| 6,098,972 | * | 8/2000 | Klimach et al. | 269/156 |

FOREIGN PATENT DOCUMENTS

| | | | | |
|---|---|---|---|---|
| 0908565 | * | 2/1982 | (SU) | 269/133 |

* cited by examiner

*Primary Examiner*—David A. Scherbel
*Assistant Examiner*—Daniel Shanley
(74) *Attorney, Agent, or Firm*—Cook, Alex, McFarron, Manzo, Cummings & Mehler, Ltd.

(57) ABSTRACT

A two-way dual action clamp for accurately clamping together two or more workpieces. The clamps are particularly useful in temporarily clamping together two European style wall cabinets prior to permanently joining the units together with a plurality of screws. Each clamp has two jaws, one L-shaped and one I-shaped which, when assembled form a U-shape. The jaws are manipulated by a hand operating screw so as to clamp together workpieces such as abutting sides of frameless cabinet units. A second hand operating screw carries a pressure plate and extends transversely through a threaded opening in the bight portion of the U-assembly. The pressure plate acts to bring edges of the cabinet units into flush relationship. The distal ends of the jaws are provided with spring actuated workpiece engaging and retaining cams which are spread apart to a limited extent when workpieces are inserted between them.

4 Claims, 2 Drawing Sheets

DUAL ACTION CLAMP

BACKGROUND OF THE INVENTION

In U.S. Pat. No. 5,697,601 dated Dec. 16, 1997 a two-way dual action clamp is disclosed for securing two or more workpieces together in a precise relationship until they can be permanently secured together and the clamp(s) removed. The particular embodiment of the invention disclosed in the patent is designed to fasten face frame cabinets. The present invention relates to similar two-way dual action clamps which are designed and adapted to fasten frame-less cabinets which are known as European style cabinets. Whereas the jaws of the clamp disclosed in U.S. Pat. No. 5,697,601 have rigid inwardly directed and longitudinally aligned workpiece retaining projections on their distal ends, which are not useful in clamping European style frame-less cabinets together, the dual action clamps of the present is invention have spring actuated cams pivotally mounted on the distal ends of the jaws for gripping together workpieces such as the abutting sides of a frame-less European style cabinet.

SUMMARY OF THE INVENTION

The object of the present invention, generally stated, is the provision of two-way dual action clamps which may be used by skilled and unskilled workers to accurately assemble and install frame-less (European style) cabinets in a relatively short period of time. Except for the addition of the spring actuated workpiece gripping cams pivotally mounted on the distal ends of the opposing jaws and the omission of the drill guide the clamps of the present invention may otherwise correspond to the clamp disclosed in U.S. Pat. No. 5,697,601.

DESCRIPTION OF THE PREFERRED EMBODIMENT

Figure 1:
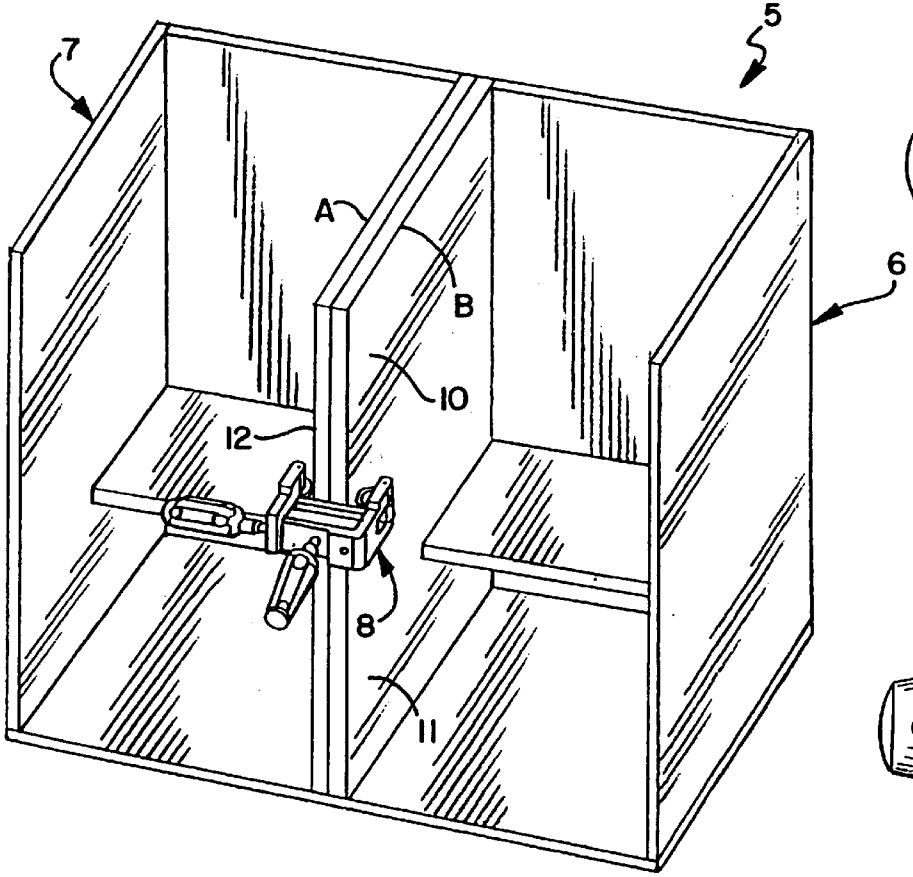
FIG. 1 is a perspective view of two European style faceless cabinet units fastened together with a clamp of the present invention prior to being permanently fastened together and installed in a desired location.

In FIG. 1 a frame-less or European style cabinet is indicated generally at 5 formed of left and right hand conventional frame-less cabinet units 6 and 7. The abutting side walls or uprights A and B of the cabinet units 6 and 7 are to be joined together as shown in FIG. 1 prior to installation of the assembled double unit cabinet 5 against a kitchen wall, for example. From FIG. 1 it will be apparent that the front vertical edges of the side walls A and B must be aligned in flush relationship before the units 6 and 7 are permanently joined together into the cabinet 5. Using one or more of the two-way dual action clamps of the present invention indicated generally at 8, the front vertical edges of the walls A and B are first accurately joined together in side by side and front-to-rear relationship as shown, and while being so clamped, holes are drilled such as at locations 10, 11 and 12 for installing screws for holding the units 6 and 7 together. The screws installed at locations 10 and 11 pass through wall B and enter wall A. The screw entering at location 12 passes through wall A and enters wall B. It will be understood that after screws have been installed such as in locations 10, 11 and 12 a number of additional screws can be installed at other locations so as to permanently secure the cabinet units 6 and 7 together.

Referring to FIGS. 2–9 the clamp 8 comprises seven main components, namely, jaws indicated generally at 13 and 14, operating hand screws indicated generally at 15 and 16, a pressure plate 17 and a pair of spring actuated pivotally mounted cams 18 and 20.

Figure 4:
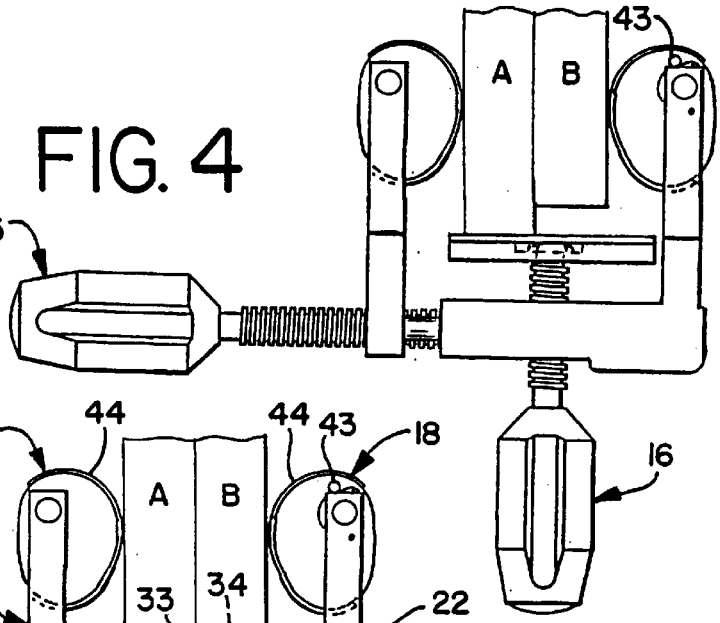
FIG. 4 is a view corresponding to FIG. 2 but illustrating the clamp engaging the abutting sides of the two cabinet units of FIG. 1 before they have been completely aligned in the front-to-rear direction.
Figure 5:
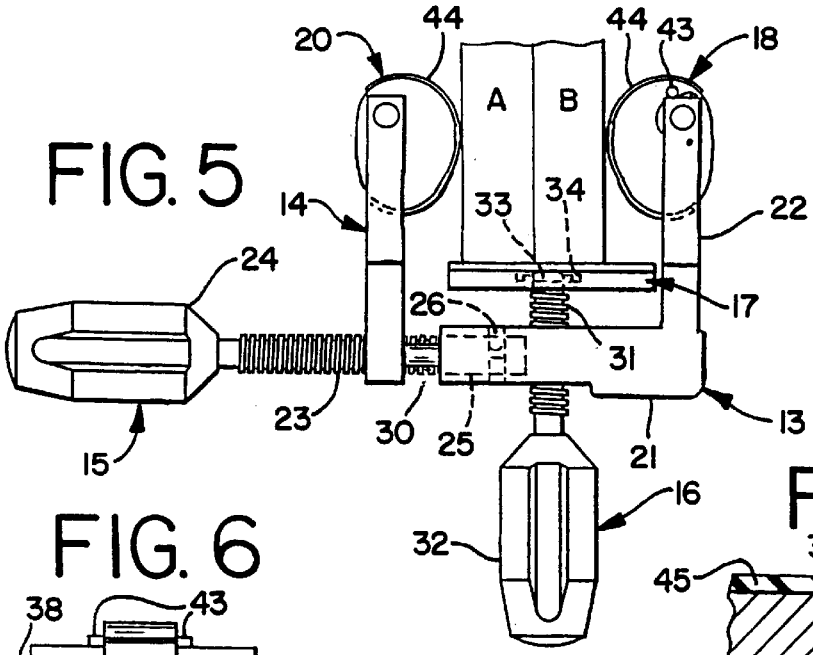
FIG. 5 is a view similar to FIG. 4 but showing the abutting sides accurately aligned and clamped together as shown in FIG. 1.

The jaw 13 is generally L-shaped while the jaw 14 is generally I-shaped. When assembled in clamp 8 the jaws 13 and 14 form a generally U-shaped assembly with one leg 21 of jaw 13 forming the bight of the U-shape. The other leg 22 of jaw 13 and jaw 14 form the opposing legs of the U-shape. The cams 18 and 20 are pivotally mounted on the distal ends of the jaws 22 and 14, respectively. In use, the cams 18 and 20 engage the sides A and B of the cabinet units 6 and 7 as shown in FIGS. 1, 4 and 5.

The operating screw 15 comprises a screw 23 having a handle 24 secured to its outer end and with its opposite end rotatedly secured in a socket 25 formed in the distal end of the bight forming leg 21 of the jaw 13. In order to secure the end of the screw 23 for rotation in the socket 25 it is provided with a circumferencial groove and a pin 26 is inserted in a hole drilled in the jaw leg 21 so as to engage the groove on one side. It will be seen that the pin 26 prevents axial movement of the screw 23 relative to the jaw 13 while allowing the screw to be freely rotated in the smooth walled socket 25.

The screw 23 has threaded engagement with a tapped or internally threaded bore 27 (FIG. 7) in what may be considered the proximal end of the jaw 14 in the U-shaped jaw configuration. The jaw 14 is maintained in its vertical oriented relationship with respect to jaw 13 by means of pins 30—30 press-fitted into openings 28—28 (FIG. 7) in the jaw 14 on opposite sides of the bore 27 with the protruding ends of the pins extending in sliding relationship into blind holes formed in the distal end of the bight 21 of the jaw 13 on opposite sides of the socket 25. It will be seen that when the screw 15 is rotated in one direction the jaw 14 will be moved toward the jaw 13 while when the screw 15 is rotated in the opposite direction the jaw 14 will be retracted or moved away from the jaw 13.

The pressure plate operating screw 16 comprises a screw 31 to the outer end of which a handle 32 is attached. The opposite end of the screw 31 has a tip 33 (FIG. 8) to which the pressure plate 17 is rotatably secured. The pressure plate has a shallow recess 34 formed in its upper side in which a washer 35 is located. The end of the tip 33 is offset over the washer 35 so as to secure the assembly together. When the screw 31 is rotated the washer 35 rotates in the recess 34 thereby retaining the pressure plate 17 in place on the end of the screw 31. The screw 31 extends through an internally threaded opening in the bight 21 of the jaw 13. It will be seen that by rotating the screw 16 the pressure plate 18 is advanced or withdrawn with respect to the bight 21 as well as with respect to the cams 18 and 20.

Each of the cams 18 and 20 is spring actuated by means of a coil spring 37 (FIG. 9) surrounding the pivot pin 38 on which the cam is mounted. One end 40 of the coil spring 37 is secured to the distal end of the jaw 14 while the opposite end 41 of the spring engages the side of a pocket 42 in the side of the cam.

Figure 2:
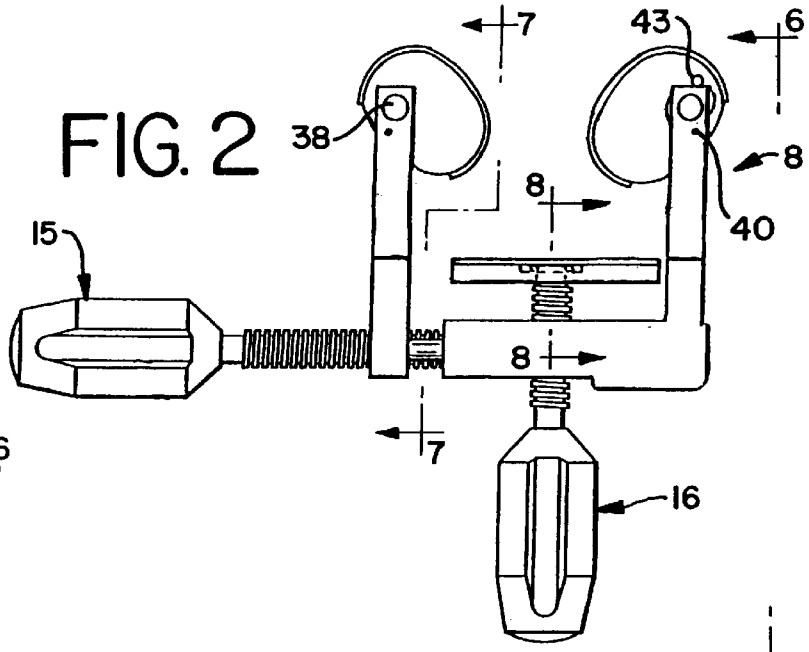
FIG. 2 is a top plan view of the clamp as shown in FIG. 1.
Figure 3:
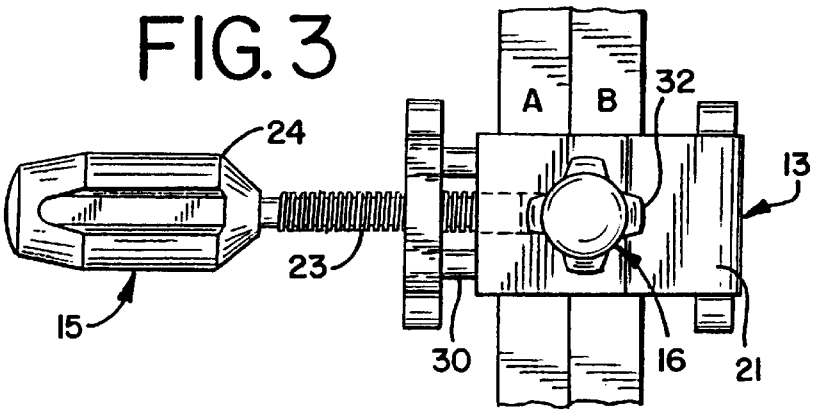
FIG. 3 is a front view of the clamp as shown in FIG. 1.
Figure 6:
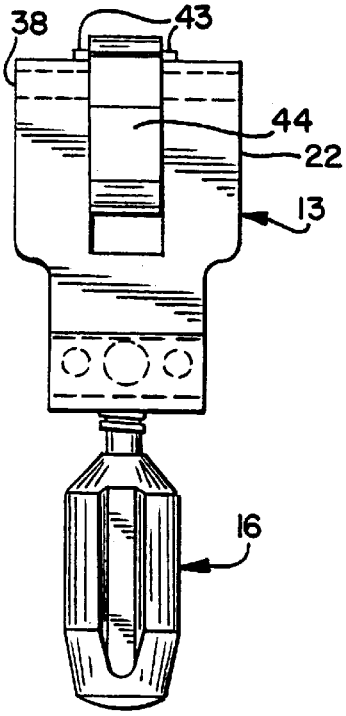
FIG. 6 is an elevational view taken on line 6—6 of FIG. 2.
Figure 7:
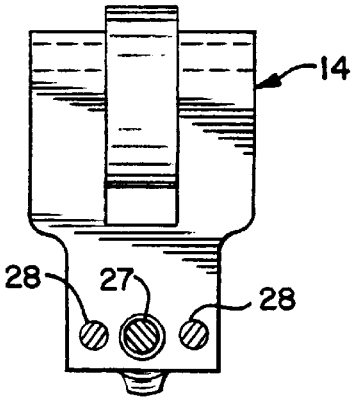
FIG. 7 is an elevational view of the inner side of the left hand jaw of the clamp as shown in FIG. 2.
Figure 8:
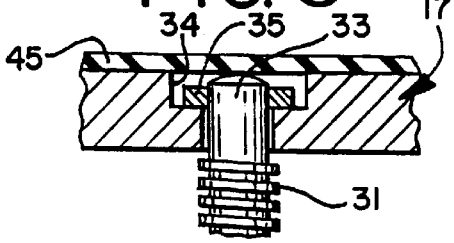
FIG. 8 is a fragmentary view on enlarged scale taken on line 8—8 of FIG. 2.
Figure 9:
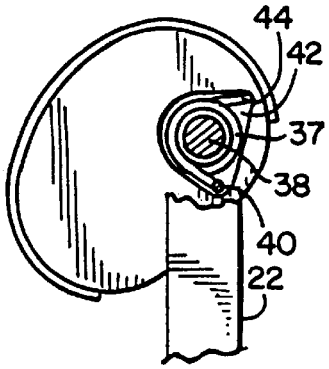
FIG. 9 is a fragmentary view on enlarged scale, partially broken away, of the right hand cam shown in FIG. 2.

The pivotal movement of each cam 18 and 20 in opposite directions is limited by a pin 43 (FIGS. 2, 5 and 6) which engages the outer ends of the jaws 14 and 22. When the clamp 8 is unengaged each pin 43 engages the outer end of its jaw as shown in FIGS. 2 and 6. When the jaws are tightened against workpieces the pins engage the jaws as shown in FIG. 4.

Each of the cams 18 and 20 is mounted in the opening formed between the bifurcated ends of the jaws 13 and 14 as shown in FIG. 6. The pins 38 on which cams 18 and 20 are mounted extend through bores in the bifurcated ends.

In operation, the separate cabinet units 6 and 7 will be placed together in approximately the position they will occupy when properly joined together to form the assembled cabinet 5. One or more of the clamps 8 will then be applied over the front edges as shown in FIG. 1. Prior to a clamp being applied the spring actuated cams 18 and 20 will occupy the positions shown in FIG. 2 in which they are closest together.

Upon a clamp 8 being applied over the vertical edges of the sides A and B the cams will be spread apart as shown in FIGS. 4 and 5. The pins 43 engage the ends of the jaws 13 and 14 as shown in FIGS. 4, 5 and 6 thereby arrest further pivoting of the cams and allow them to forcibly engage the sides A and B. Preferably each cam 18 and 20 is provided with a surface covering of tape or other material which has frictional engagement with the cabinet material. The tape or other surface covering is indicated at 44—44. When the sides A and B are completely aligned and flush both edges will rest against the pressure plate 17 as shown in FIG. 5. The pressure plate is also provided with a covering of tape 45.

If both of the cabinet units 6 and 7 are resting on a level surface it may suffice to apply one or more clamps 8 to the front or vertical edges of the abutting sides A and B. Otherwise it may be desirable to apply a clamp to the upper edges whereby the cabinet units 6 and 7 will be properly oriented and joined both horizontally and vertically. After a sufficient number of screws have been installed with the clamp(s) 8 in place, the clamp(s) will be removed by manipulating the screws 15 and 16 in the appropriate directions.

While spring actuated clamps 18 and 20 have a desirable shape it will be understood that cams having different shapes can be used which function in substantially the same way as cams 18 and 20.

What is claimed is:

1. A two-way dual action clamp for clamping multiple workpieces in desired alignment with each other, comprising:

a pair of clamping jaws assembled to form a U-shaped assembly, a spring actuated workpiece engaging and retaining cam pivotally mounted on the distal end of at least one of the two legs of said U-shaped clamping jaw assembly, a workpiece engaging and retaining component located on the distal end of the other of said two legs in opposed alignment with said cam, a first clamp operating screw operably connected with said assembled jaws for causing said jaws to either separate or close together, a second clamp operating screw operably connected with the bight portion of said U-shaped assembly of said pair of clamping jaws and extending transversely in screw-threaded relationship therethrough, and a pressure plate mounted on the distal end of said second clamp operating screw for engaging and orienting workpieces clamped between said jaws, said first screw being longitudinally aligned with said bight portion of said U-shaped assembly.

2. A two-way dual action screw clamp for clamping multiple workpieces in a desired alignment with each other, comprising:

a L-shaped jaw, an I-shaped Jaw, said jaws being assembled to form a U-shaped assembly with one leg of said L-shaped jaw forming the bight portion of said U-shaped jaw assembly, a spring actuated workpiece engaging and retaining cam pivotally mounted on the distal end of each leg of said U-shaped assembly, said cams being longitudinally aligned, a first clamp operating screw operably connected with said jaws for causing said jaws to either separate or to close together, a second clamp operating screw operably connected with said bight portion forming leg and extending transversely in screw-threaded relationship therethrough, and a pressure plate mounted in free-to-rotate relationship on the distal end of said second screw for engaging and orienting workpieces clamped between said jaws, said first screw being longitudinally aligned with said bight portion of said L-shaped leg and with the distal ends of said first screw being secured in free rotating relationship in the distal end of said bight portion and extending transversely in screw-threaded relationship through said I-shaped jaw.

3. The two-way dual action screw clamp of claim 2 wherein longitudinal axes of said first and second screws intersect at right angles.

4. The two-way dual action clamp of claim 2 wherein a pin projects from one side of each said cams in a position to engage the distal end of each said jaw and limit the pivotal movement of each cam between its non-clamping and clamping position.

* * * * *